US005306433A

United States Patent [19]

Leach

[11] Patent Number: 5,306,433

[45] Date of Patent: Apr. 26, 1994

[54] METHOD OF CHANGING COMPOSITIONS OF CIRCULATING SOLVENT IN SOLVENT DEWAXING

[75] Inventor: Lyle A. Leach, Morphett Vale, Australia

[73] Assignee: Mobil Oil Corporation, Fairfax, Va.

[21] Appl. No.: 986,211

[22] Filed: Dec. 7, 1992

Related U.S. Application Data

[63] Continuation-in-part of Ser. No. 714,430, Jun. 12, 1991, Pat. No. 5,190,672.

[51] Int. Cl.[5] ..... B01D 33/48; C10G 73/22

[52] U.S. Cl. ..... 210/772; 208/38; 210/774; 210/784; 210/798

[58] Field of Search ..... 210/634, 772, 784, 791, 210/797, 798, 805, 806, 774; 208/33, 38; 196/14.5

[56] References Cited

U.S. PATENT DOCUMENTS

| | | | |
|---|---|---|---|
| 2,368,497 | 1/1945 | Shipley, Jr. et al. | 196/5 |
| 2,397,868 | 4/1946 | Jenkins | 196/18 |
| 2,454,447 | 11/1948 | Harney, Jr. et al. | 202/42 |
| 2,582,214 | 1/1952 | Twigg | 202/60 |
| 2,695,867 | 11/1954 | Chambers | 202/42 |
| 2,742,401 | 4/1956 | Kinchen | 208/38 |
| 3,239,446 | 3/1966 | Demeester et al. | 208/33 |
| 3,650,942 | 3/1972 | Hoppe | 208/31 |
| 4,033,855 | 7/1977 | Putz | 208/25 |
| 4,088,564 | 5/1978 | Perry et al. | 208/33 |
| 4,186,059 | 1/1980 | Fleck | 203/14 |

FOREIGN PATENT DOCUMENTS

| | | | |
|---|---|---|---|
| 82/00029 | 1/1982 | PCT Int'l Appl. | 208/38 |

OTHER PUBLICATIONS

Hengstebeck, R. J., Petroleum Processing, Principles and Applications, New York: McGraw-Hill Book Co. (1959).

Hobson, G. D., ed., Modern Petroleum Technology, 4th ed., Great Britain: Applied Science Publishers, Ltd. (Date Unknown).

*Primary Examiner*—Joseph W. Drodge

*Attorney, Agent, or Firm*—Alexander J. McKillop; Dennis P. Santini; Lori F. Cuomo

[57] ABSTRACT

An improved solvent dewaxing process in which a method and apparatus for continuous hot wash of a dewaxing filter is disclosed. A hot wash solvent is continuously sprayed below the doctor blade followed by a cold solvent spray below the hot solvent spray. Additionally, a solvent management process for changing the proportions of the solvent in response to different viscosity feedstocks thereby increasing filtration efficiency is also disclosed.

11 Claims, 2 Drawing Sheets

METHOD OF CHANGING COMPOSITIONS OF CIRCULATING SOLVENT IN SOLVENT DEWAXING

CROSS-REFERENCE TO RELATED APPLICATIONS

This application is a continuation-in-part of application Ser. No. 07/714,430, filed Jun. 12, 1991, now U.S. Pat. No. 5,190,672.

FIELD OF THE INVENTION

This invention relates to an improved process in which filter efficiency is increased in solvent dewaxing units. In particular, the invention provides a process for changing the proportions of the solvent and a method and apparatus for continuous filter hot wash.

BACKGROUND OF THE INVENTION

MEK(methyl ethyl ketone) dewaxing is the process most widely used. In MEK dewaxing, the wax bearing feed is mixed with solvent and the mixture is chilled to crystallize the wax. The chilled feed is then filtered continuously. Filtration is generally carried out in rotary drum filters. The filtration zone is at the bottom of the drum with cold wash solvent introduced at the top of the drum in the form of a spray to remove occluded filtrate.

The solvent used in the process usually contains from about 45 percent to about 75 percent MEK, with the remainder toluene. The concentration of MEK is different for each feedstock depending on the viscosity of the feed. The MEK component of the solvent induces wax precipitation while the toluene component maintains the oil in solution. MEK dewaxing is described in further detail in Hobson et al., *Modern Petroleum Technology* 427–429 (1975) and Hengstebeck, *Petroleum Processing Principles and Applications* 256–257 (1959).

Continuous filters are used in lube oil dewaxing. U.S. Pat. No. 3,791,525 to Harris et al. teaches a conventional rotary filter dewaxing apparatus.

The filtration rate generally declines as openings in the filter cloth plug up with small wax and ice particles, requiring periodic washing with hot solvent to remove the materials blocking the filter cloth. The filter must be taken off stream approximately every eight hours in order to wash with the hot solvent to restore the filter to the maximum filtration capacity No industrial dewaxing filters are known to be provided with continuous hot wash capability. Therefore, it is an object of the present invention to provide a method and apparatus for continuously applying a hot wash solvent to a dewaxing filter in order to increase production capacity.

The filterability of the wax is also dependent on the viscosity of the solution. Feed viscosity is different for each feedstock. A paraffin distillate has a different viscosity than a light motor oil. Therefore, it is a further object of the present invention to provide a method for changing proportions of the solvent when processing different viscosity feedstocks.

SUMMARY OF THE INVENTION

The present invention provides an improved solvent dewaxing process in which the filter efficiency is increased. In a first embodiment the invention relates to a method and apparatus for continuously applying hot wash solvent to a filter cloth. Continuous operation of the filter would increase the production capacity of the dewaxing unit. The filter would not have to be taken out of service on a regular basis. Further, the filter would always be operating at the maximum possible filtration rate.

In a second embodiment the invention relates to a process for changing the proportions of the solvent when processing different viscosity feedstocks. The solvent composition if necessary can be changed as the feedstock is changed and thus maximum efficiency may be achieved over a wide range of operating conditions.

The invention therefore includes, in a first process aspect, a process for continuously applying hot wash solvent to a rotary drum filter having a doctor blade and filter cloth and used for lube oil dewaxing which comprises:

discharging wax at said doctor blade;

directing a spray of hot solvent below said doctor blade; and applying a cold solvent spray below said hot solvent spray to cool said filter cloth back to filtration temperature.

In its apparatus aspects the invention comprises a continuous filter apparatus for use in lube oil dewaxing said apparatus comprising:

a rotary drum filter, having a filter cloth;

a doctor blade engaging the filter cloth of said rotary drum filter;

an outlet for withdrawing wax at said doctor blade;

a conduit for directing a spray of hot solvent wash against the filter cloth below said doctor blade; and a conduit for applying a spray of cold solvent wash to the filter cloth below the hot solvent wash conduit.

The invention provides in a second process aspect a process for changing the composition of circulating solvent in an MEK dewaxing unit comprising the steps of:

subjecting a petroleum feedstock to solvent dewaxing and thereafter recovering solvent from both the dewaxed filtrate and the separated wax by evaporation and stripping;

dehydrating the recovered solvent to form a dry solvent and recycling said dry solvent to the dewaxing unit:

running a part of said dry solvent into a tank;

gradually splitting said dry solvent from the dry solvent tank into an MEK fraction and a toluene fraction and storing each fraction in a separate tank; and replacing the solvent volume routed to the dry solvent tank with MEK recovered from the solvent splitter

DETAILED DESCRIPTION OF THE INVENTION

Feedstocks useful for the present solvent dewaxing process include deasphalted vacuum resid and solvent extracted (furfural, N-methyl-2-pyrrolidone (NMP) or phenol) vacuum distillates.

The dewaxing solvent is preferably a mixture of MEK and toluene. Other suitable dewaxing solvents include, but are not limited to, methyl isobutyl ketone (MIBK), acetone and propane.

The particular operating conditions used in the present process will depend on the specific solvent, and will vary within the disclosed ranges depending upon the available feedstock and the desired lube oil quality. Process conditions such as temperature, pressure, space velocity and molar ratio of reactants will affect the characteristics of the resulting lube oil, and may be adjusted within the disclosed ranges with only minimal trial and error by those skilled in the art.

TABLE 1

| PROCESS CONDITIONS | Broad | Preferred |
|---|---|---|
| Filtration temperature, °C. | −30 to −5 | −25 to −12 |
| Filtration pressure, psig | 0 to 5 | 1 to 3 |
| Wash solvent pressure, psig | 50 to 120 | 60 to 75 |
| Viscosity of feed (solvent free), Kinematic viscosity (KV), centipoise (CS) @ 100° C. | 2 to 35 | |

In a first embodiment the invention relates to a novel method and apparatus for continuously applying hot wash solvent to a dewaxing filter. The technique is based on applying hot solvent and cold solvent concurrently to the filter. The use of the hot wash solvent during filtration avoids the necessity of taking the filter out of service for approximately twenty minutes every eight hours to remove the materials that plug the filter cloth.

In the MEK process the waxes present in the oil feedstock are removed by mixing the feedstock with a dual solvent consisting of MEK and toluene, chilling the oil/solvent mixture and continuously filtering.

The solvent to feedstock ratio generally falls within the range of from about 1.7 to 3.0.

The filter employed in the present invention is a rotary drum filter. Rotary drum filters are described in detail in *Kirk-Othmer Encyclopedia of Chemical Technology*, volume 10, p. 314–318.

Figure 1:
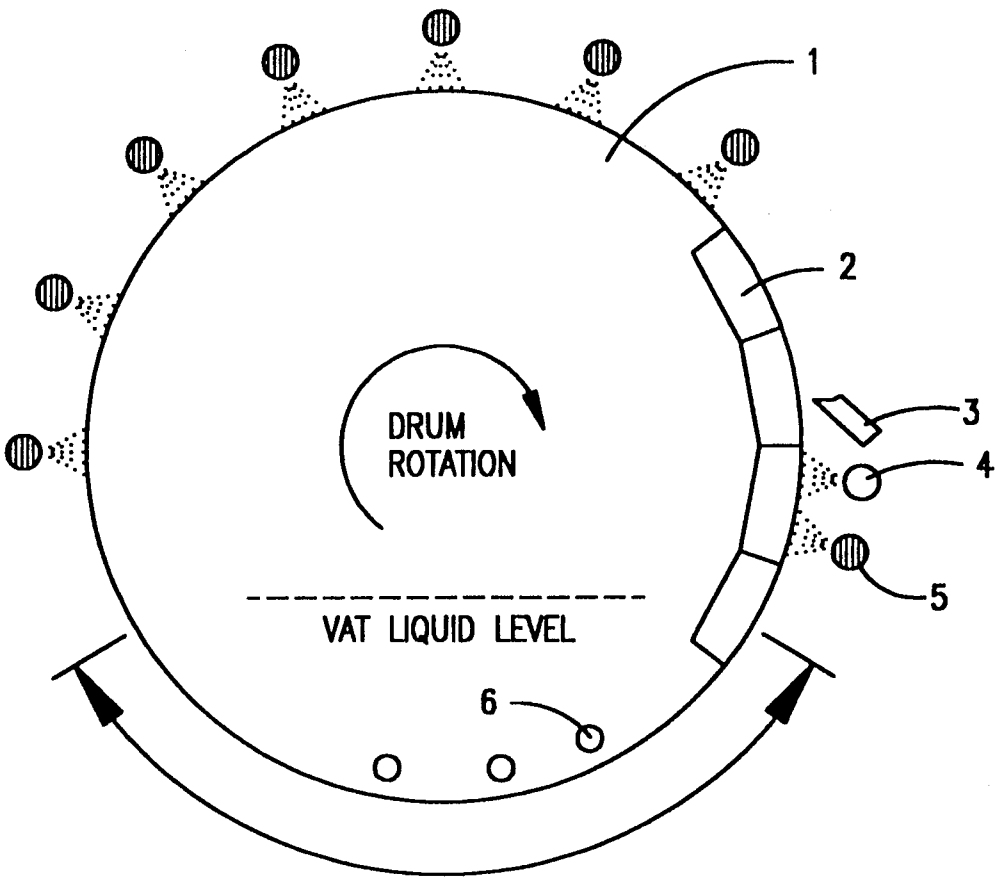
FIG. 1 is a simplified schematic diagram illustrating the filter apparatus of the present invention.

A schematic of the overall configuration of the filter apparatus is shown in FIG 1. The oil/solvent mixture is continuously contacted in rotary drum 1 with cold wash solvent spray 5 and dewaxed oil is continuously discharged through port 6. Wax is discharged from the filter cloth 2 of rotary drum 1 at the doctor blade 3. Below the doctor blade the filter cloth 2 is subjected to a spray of hot wash solvent 4. Immediately following the hot wash solvent spray 4 a cold wash solvent spray 5 is applied to cool the filter cloth 2 back to the filtration temperature.

Cold wash solvent temperatures generally match filter feed temperatures, falling within the range of from about −30° to about −5° C. The temperature of the hot wash solvent typically falls within the range of from about 75° to about 85° C.

Continuous filter operation would increase production capacity of a dewaxing unit since the filter would not have to be taken out of service. The filter would always operate at the maximum possible filtration rate which would represent a 10-15% increase in production for filtration rate limited feeds.

The maximum MEK content of the solvent is different for each feedstock. In order to optimize operation for each stock, it is necessary to have the capability to remove water from the solvent, separate MEK from toluene, and control the composition of the solvent circulated within the process.

Figure 2:
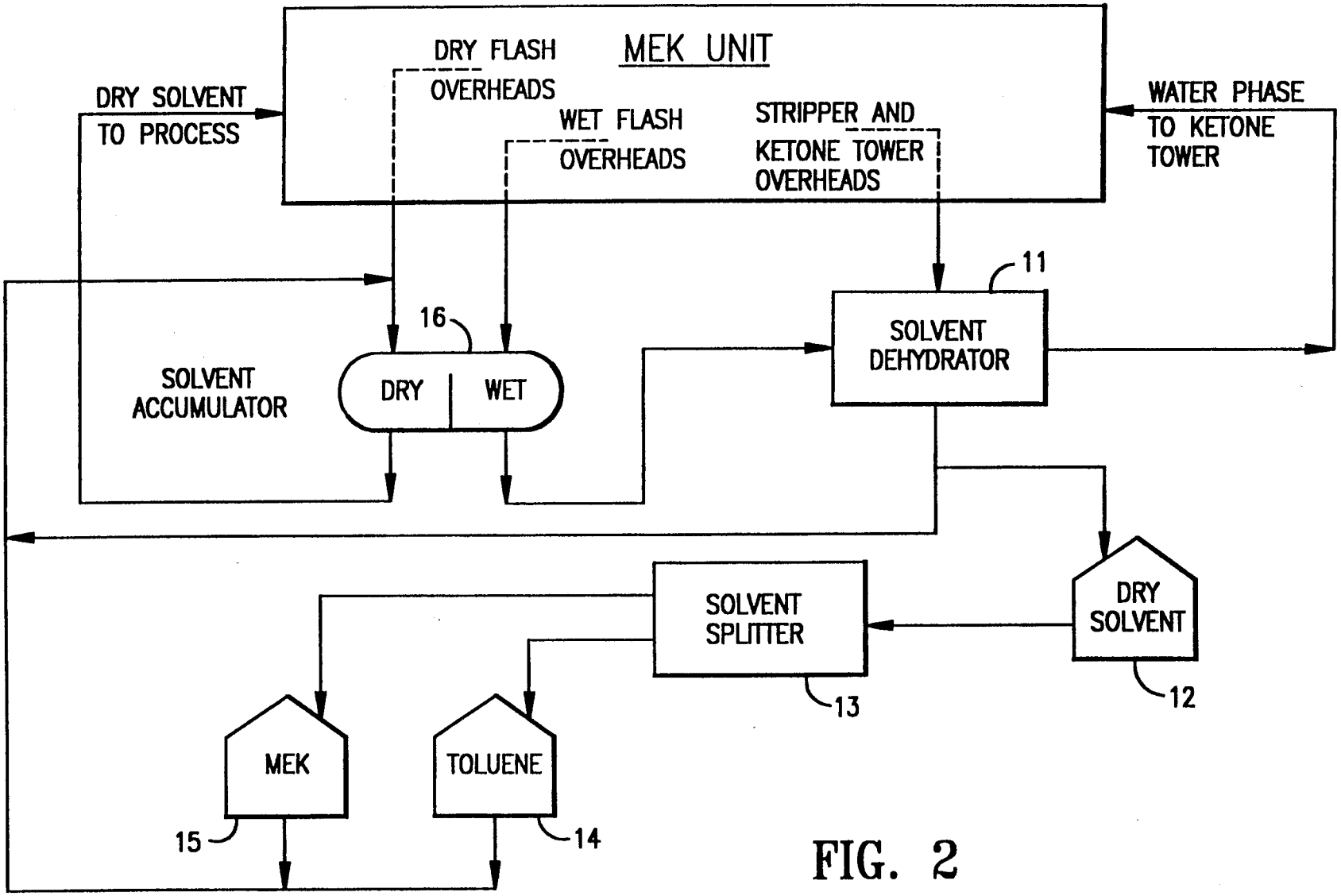
FIG. 2 is a simplified schematic diagram illustrating the solvent management process of the present invention.

A schematic of the overall configuration of a solvent management system is shown in FIG. 2. Solvent is continuously circulated through the MEK unit. Wate is introduced into the MEK unit as the result of steam stripping to remove trace solvent from the dewaxed oil and slack wax products. This water forms an azeotrope with MEK. Most of the water may be removed by decantation. This is achieved by selectively mixing the various solvent streams in a series of decanters to reduce the solvent water content to about 1 to about 2% water in the wet solvent.

Water also enters the MEK unit with the charge oil. Most of the water in the charge and circulating solvent is concentrated in the slack wax product from the filters and is recovered with the solvent flashed overhead in the slack wax low pressure and high pressure flash towers. Water in the solvent is detrimental to MEK unit performance because of the potential for icing of equipment in chilling service, ice plugging of filter cloths, and the possibility of filter feed third phasing.

The wet solvent recovered from the stripper and ketone tower overheads from the MEK unit is dehydrated, preferably to about 0.1 to 0.2 wt. % water, in the solvent dehydrator 11. When it is desired to change the concentration of the solvent in the unit, part of the dry solvent is run into a the dry solvent tank 12. The solvent from the dry solvent tank is routed to the solvent splitter 13 where it is split into a relatively pure MEK stream, generally about 90 to about 95 wt. % MEK, and a relatively pure toluene stream, generally about 90 to about 95 wt. % toluene, and stored in the MEK tank 15 and the toluene tank 14, respectively. The solvent volume routed to the dry solvent tank is replaced with either MEK or toluene from the MEK tank or the toluene tank and sent to the dry solvent accumulator 16 for use in the MEK dewaxing process. This effects a rapid change in the solvent inventory composition.

The filter feed viscosity can be reduced by increasing the percentage of MEK in the solvent thereby increasing the filtration rate. For example, the percentage of MEK in the circulating solvent can be changed from 60% MEK to 70% MEK, a 10% composition shift, over a period within the range of from about 4 to about 8 hours.

Another advantage of increasing the percentage of MEK is operation at higher filter feed temperatures which further increases filtration rate by reducing liquid viscosity. The combined effect of the increased MEK concentration and the higher filter feed temperatures result in unit rate increases of about 10 to about 12%, depending on the specific stock being processed. A further advantage of higher filter feed temperatures is the use of less refrigeration, thereby increasing unit capacity, in cases where refrigeration is limiting.

Another advantage of storing dry solvent in a tank followed by the gradual splitting of the solvent is the maximization of MEK unit throughput with minimum investment. Alternatively, a large solvent splitter could be used. However, the large solvent splitter would require a more substantial capital investment and only be in service a few hours a week. Another alternative, slowly changing the solvent composition, would not allow maximum operating time at the optimum solvent concentration.

The following example illustrates the process of the present invention.

EXAMPLE

In a 5,000 barrel per day (BPD) MEK unit, wet solvent from the dewaxed oil flash overheads flows first to the solvent accumulator 16 and then is pumped to the top of the solvent dehydrator 11. Wet solvent overhead streams from the product stripper and ketone tower are fed directly to the solvent dehydrator 11. The combined wet solvent rate to the dehydrator is 13,000 BPD. The solvent dehydrator is a tower which contains 10 theoretical stages and is reboiled by a thermosiphon reboiler. The reboiler uses low pressure steam to supply the heat required to achieve the desired dry solvent purity. The bottoms temperature for the dehydrator ranges between about 200°-215° F. and is set by the desired water content in the dry solvent which is below about 0.1 wt. %. The overhead vapor from the dehydrator, which is a water/MEK azeotrope containing trace amounts of toluene are condensed and subcooled at 115° F. and sent back to the ketone tower. 11,000 BPD dry solvent from the dehydrator bottoms is then returned to the solvent accumulator 16 for reuse in the process.

When it is desired to change the percentage of MEK in the circulating solvent by 10%, 4,000 BPD of dry solvent is withdrawn from the dehydrator bottoms stream and pumped to dry solvent tank 12. The amount of solvent withdrawn is dependent on initial solvent composition and inventory in the unit and is calculated as required to achieve the desired change in final solvent composition and can range from 10 to 80% of the total solvent inventory. In order to maintain constant system inventory, either dry MEK from MEK tank 15 or dry toluene from toluene tank 14 is pumped upstream of the dry solvent accumulator 16. The solvent transfer is continued until the desired MEK composition is reached. Both solvent transfer pumps are shut off and the dewaxing operation is continued.

The solvent mix is pumped from the dry solvent tank 12, at a rate of 1,500 BPD to the solvent splitter 13 where it is distilled to an overhead product having a minimum MEK purity of 95 vol % and a bottoms product having a minimum toluene purity of 95 vol %. The solvent splitter tower contains 10 theoretical stages and is reboiled by a thermosiphon reboiler. The reboiler uses medium pressure steam to supply the heat required to achieve the desired bottoms product purity. The bottoms temperature for the splitter is in the range of about 250° to about 260° F. The 0.1 wt. % water contained in the feed is concentrated in the MEK product.

Changes and modifications in the specifically described embodiments can be carried out without departing from the scope of the invention which is intended to be limited only by the scope of the appended claims.

What is claimed is:

1. A process for changing the composition of total circulating solvent in an MEK dewaxing unit including a dewaxing filter comprising the steps of:

subjecting a petroleum feedstock to solvent dewaxing and thereafter recovering solvent from dewaxed filtrate and separated wax by evaporation and stripping;

dehydrating the recovered solvent from said evaporation and stripping to form a dry solvent and recycling said dry solvent to the dewaxing unit;

passing a portion of said dry solvent into a dry solvent tank;

splitting said dry solvent from the dry solvent tank in a solvent splitter into an MEK rich fraction and a toluene rich fraction and storing each fraction in a separate tank; and replacing the dry solvent portion passed to the dry solvent tank with an amount of MEK rich fraction recovered from the solvent splitter.

2. The process of claim 1 wherein said composition of total circulating solvent is changed by about 10%.

3. The process of claim 1 wherein said composition of total circulating solvent is changed from about 60% MEK to about 70% MEK.

4. The process of claim 1 wherein said composition of total circulating solvent is changed over a period within the range of from about 4 to about 8 hours.

5. The process of claim 1 wherein the dewaxing filter comprises a rotary drum filter having continuous hot solvent wash capability.

6. The process of claim 1 wherein the recovered solvent is dehydrated to about 0.1 to about 0.2 wt. % water.

7. The process of claim 1 wherein the MEK fraction is at least about 90 wt. % MEK.

8. The process of claim 1 wherein the toluene fraction is at least about 90 wt. % toluene.

9. A process for changing the composition of total circulating solvent comprising a first solvent and a second solvent in a solvent dewaxing unit including a dewaxing filter comprising the steps of:

subjecting a petroleum feedstock to solvent dewaxing and thereafter recovering solvent from dewaxed filtrate and separated wax by evaporation and stripping;

dehydrating the recovered solvent from said evaporation and stripping to form a dry solvent and recycling said dry solvent to the dewaxing unit;

passing a portion of said dry solvent into a dry solvent tank;

splitting said dry solvent from the dry solvent tank in a solvent splitter into a first solvent rich fraction and a second solvent rich fraction and storing each fraction in a separate tank; and replacing the dry solvent portion passed to the dry solvent tank with an amount of first solvent rich fraction recovered from the solvent splitter.

10. The process of claim 9 wherein said composition of total circulating solvent is changed by about 10% over a period within the range of from about 4 to about 8 hours.

11. The process of claim 9 wherein said dewaxing filter is a rotary drum filter including a doctor blade and filter cloth, operated at a filtration temperature in the range of from about −30° C. to about −5° C. and wherein hot solvent wash is continuously applied by a process which comprises:

discharging wax at said doctor blade;

continuously directing a spray of hot solvent below said doctor blade of said rotary drum filter, said hot solvent having a temperature in the range of from about 75° C. to about 85° C.; and continuously directing a cold solvent spray below said hot solvent spray to cool said filter cloth back to filtration temperature, wherein said cold solvent spray is at about the filtration temperature.

* * * * *